US010323662B2

(12) United States Patent
Duffer et al.

(10) Patent No.: US 10,323,662 B2
(45) Date of Patent: Jun. 18, 2019

(54) SYSTEM, METHOD, AND APPARATUS TO RETAIN IN-CYLINDER LINEAR POSITION SENSOR

(71) Applicant: Caterpillar Inc., Peoria, IL (US)

(72) Inventors: Bradly G. Duffer, East Peoria, IL (US); Philip A. Thompson, Champaign, IL (US)

(73) Assignee: Caterpillar Inc., Deerfield, IL (US)

( * ) Notice: Subject to any disclaimer, the term of this patent is extended or adjusted under 35 U.S.C. 154(b) by 167 days.

(21) Appl. No.: 15/274,799

(22) Filed: Sep. 23, 2016

(65) Prior Publication Data

US 2018/0087548 A1 Mar. 29, 2018

(51) Int. Cl.
*F15B 15/28* (2006.01)
*F15B 15/14* (2006.01)

(52) U.S. Cl.
CPC ..... *F15B 15/2892* (2013.01); *F15B 15/1433* (2013.01)

(58) Field of Classification Search
CPC ..... F15B 15/2892; F15B 15/1433
See application file for complete search history.

(56) References Cited

U.S. PATENT DOCUMENTS

| | | | | |
|---|---|---|---|---|
| 6,509,733 | B2 * | 1/2003 | Blubaugh | F15B 15/2892 324/207.13 |
| 8,967,035 | B2 | 3/2015 | Subrt | |
| 2010/0285706 | A1 * | 11/2010 | Meguro | B63H 20/10 440/61 T |
| 2015/0096438 | A1 | 4/2015 | Subrt | |

FOREIGN PATENT DOCUMENTS

| | | | |
|---|---|---|---|
| CN | 202023795 | U | 11/2011 |
| CN | 104033451 | A | 9/2014 |
| CN | 204199365 | U | 3/2015 |
| DE | 203 12 472 | U1 | 11/2003 |
| DE | 103 13 697 | A1 | 12/2004 |
| EP | 1 366 301 | B1 | 11/2004 |

* cited by examiner

*Primary Examiner* — F Daniel Lopez
(74) *Attorney, Agent, or Firm* — Oblon, McClelland, Maier & Neustadt

(57) ABSTRACT

A system, a method, and an apparatus to retain an in-cylinder linear position sensor in a cavity of a housing of a hydraulic cylinder assembly are described. The in-cylinder linear position sensor includes a sensor body that houses circuitry of the in-cylinder linear position sensor, and a sensor cap that extends from an upper surface of the sensor body. The sensor cap has a retention mechanism with a portion that extends radially outward relative to a central vertical axis of the sensor body so as to extend into and engage a wall of an access port of the housing to hold the in-cylinder linear position sensor in the cavity of the housing. The portion of the retention mechanism is configured to move inward from an outer position toward the central vertical axis of the sensor body.

19 Claims, 7 Drawing Sheets

SYSTEM, METHOD, AND APPARATUS TO RETAIN IN-CYLINDER LINEAR POSITION SENSOR

TECHNICAL FIELD

The present disclosure relates to hydraulic cylinder assemblies, and more particularly, to systems, methods and apparatuses to retain an in-cylinder linear position sensor in a housing of a hydraulic cylinder.

BACKGROUND

Hydraulic cylinder assemblies having a cylinder, a piston received within the cylinder, and a rod connected to the piston, may have applications in various industrial, earth-moving and material handling machines and vehicles. Such hydraulic cylinder assemblies typically include an in-cylinder linear position sensor, to determine position of the rod within the cylinder. Assembly and retention of the in-cylinder linear position sensor in the cylinder may be done using one or more set screws tightened into a retention gland in a side of the sensor housing. However, such tightening of the set screw may be difficult because of the potential for over torqueing the set screw, or inaccurate seating of the set screw in the retention gland, which may lead to damage of the in-cylinder linear position sensor or cylinder. Further, removal of the in-cylinder linear position sensor installed using set screws may be problematic because improper removal procedures of the one or more set screws (e.g., failing to remove all set screws) may lead to damage of the in-cylinder linear position sensor and/or the cylinder.

U.S. Patent Publication No. 2015/0096438 (hereinafter the '438 publication) describes a cylinder assembly that includes a cylinder position sensor assembly having a cylinder position sensor for sensing the position of a rod member. According to the '438 publication, the cylinder position sensor may be held in position by spring force applied by a spring member, such that the cylinder position sensor is always disposed in close proximity to the rod member. A hydraulic cap may act as a cover and apply a push force on the spring member to compress the spring member to keep the cylinder position sensor in position.

SUMMARY OF THE DISCLOSURE

In one aspect of the present disclosure, a hydraulic cylinder assembly is provided. The hydraulic cylinder assembly includes a cylinder housing having a body that defines a first cavity to movably house a piston and a portion of a rod connected to the piston, a head cap adjacent the body that defines a second cavity adjacent the first cavity, a first access port adjacent the second cavity that extends horizontally in a first direction to a first outer surface of the head cap, and a second access port that extends horizontally in a second direction to a second outer surface of the head cap. The hydraulic cylinder assembly further includes an in-cylinder linear position sensor mechanically held in the second cavity. The in-cylinder linear position sensor includes a sensor cap extending from a top surface of a sensor body of the in-cylinder linear position sensor. The sensor cap has a retention mechanism with a latch extending horizontally in the first direction so as to engage an upward facing bottom surface of the first access port. The first access port has a length greater than a width that extends in the first direction. The latch has a chamfered upper end surface configured to interact with a chamfered interface between the body and the head cap of the cylinder housing to insert the in-cylinder linear position sensor into the second cavity.

In another aspect of the present disclosure, an in-cylinder linear position sensor configured to be mechanically held in a cavity of a housing of a hydraulic cylinder assembly is provided. The in-cylinder linear position sensor includes a sensor body configured to house circuitry of the in-cylinder linear position sensor, and a sensor cap extending from an upper surface of the sensor body. The sensor cap has a latch that extends horizontally past an outer surface of the sensor body in a fully extended state of the latch. The latch has a chamfered upper surface portion and an inclined lower surface portion. The latch is configured to move horizontally inward from an outer-most position of the fully extended state toward a central vertical axis of the sensor body.

In yet another aspect of the present disclosure, a method is provided. The method includes providing a sensor body that houses circuitry of an in-cylinder linear position sensor. The method further includes providing a sensor cap extending from an upper surface of the sensor body. The sensor cap has a latch that extends radially outward relative to a central vertical axis of the sensor body. The latch is configured to move inward from an outer-most position toward the central vertical axis of the sensor body.

Other features and aspects of this disclosure will be apparent from the following description and the accompanying drawings.

BRIEF DESCRIPTION OF THE DRAWINGS

The accompanying drawings, which are incorporated in and constitute a part of the specification, are illustrative of one or more embodiments of the disclosed subject matter, and, together with the description, explain various embodiments of the disclosed subject matter. Further, the accompanying drawings have not necessarily been drawn to scale, and any values or dimensions in the accompanying drawings are for illustration purposes only and may or may not represent actual or preferred values or dimensions. Where applicable, some or all select features may not be illustrated to assist in the description and understanding of underlying features.

DETAILED DESCRIPTION

Figure 1:
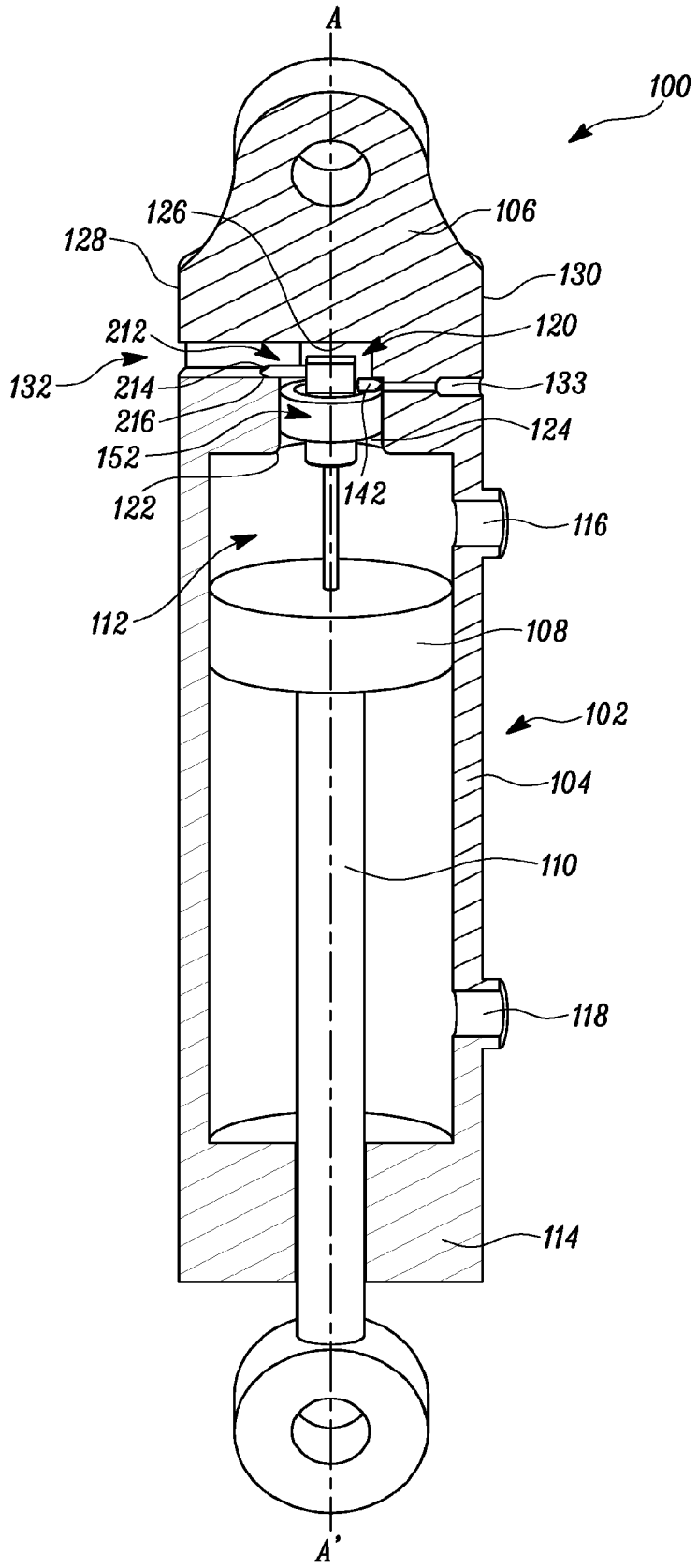
FIG. 1 is a side sectional view of a hydraulic cylinder assembly according to one or more embodiments of the present disclosure.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, well-known structures and components may be shown in block diagram form in order to avoid obscuring the concepts of the described subject matter. Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter may and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Generally speaking, embodiments of the disclosed subject matter involve retention and release of an in-cylinder linear position sensor relative to a housing of a hydraulic cylinder. Retention and release of the in-cylinder linear position sensor may be implemented by a retention mechanism of the in-cylinder linear position sensor. At least a portion of the retention mechanism may be in an extended position to retain the in-cylinder linear position sensor in the housing of the hydraulic cylinder. The portion of the retention mechanism may move radially inward to a retracted position to release the in-cylinder linear position sensor from the housing of the hydraulic cylinder. The portion of the retention mechanism may also be moved radially inward to the retracted position to install the in-cylinder linear position sensor in the housing of the hydraulic cylinder.

Hydraulic cylinder assemblies according to embodiments of the disclosed subject matter, such as hydraulic cylinder assembly 100 (see FIGS. 1, 2, and 3), hydraulic cylinder assembly 200 (see FIG. 4), and hydraulic cylinder assembly 300 (see FIG. 5), may be implemented in any suitable machine, such as, but not limited to, a wheel loader, a wheel tractor scraper, an excavator, a track-type tractor, an articulated mining truck, large mining trucks, and/or any other machine with hydraulic component(s). Further, such hydraulic cylinder assemblies may find application in any machine involving use of an articulating member or members, such as buckets, booms, work tool, etc.

Figure 2:
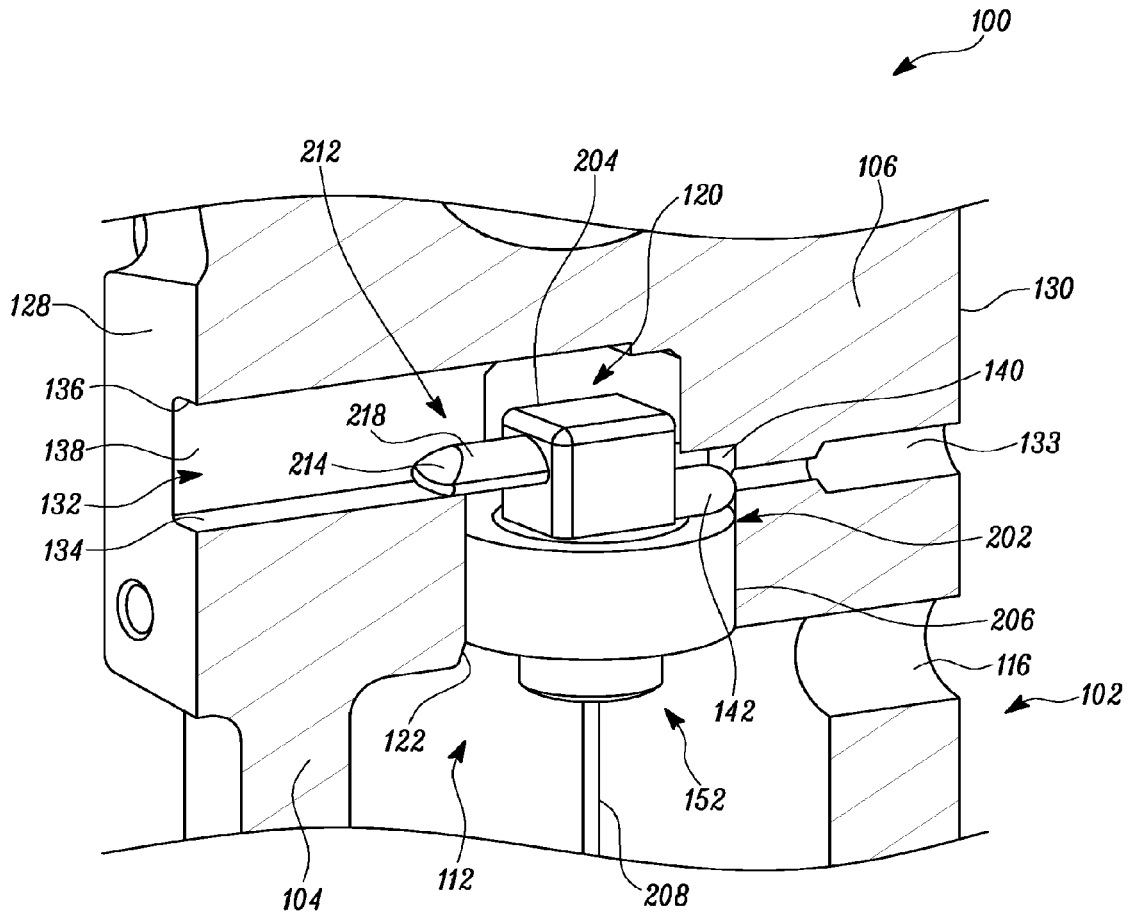
FIG. 2 is a side sectional perspective view of a portion of the hydraulic cylinder assembly of FIG. 1.
Figure 3:
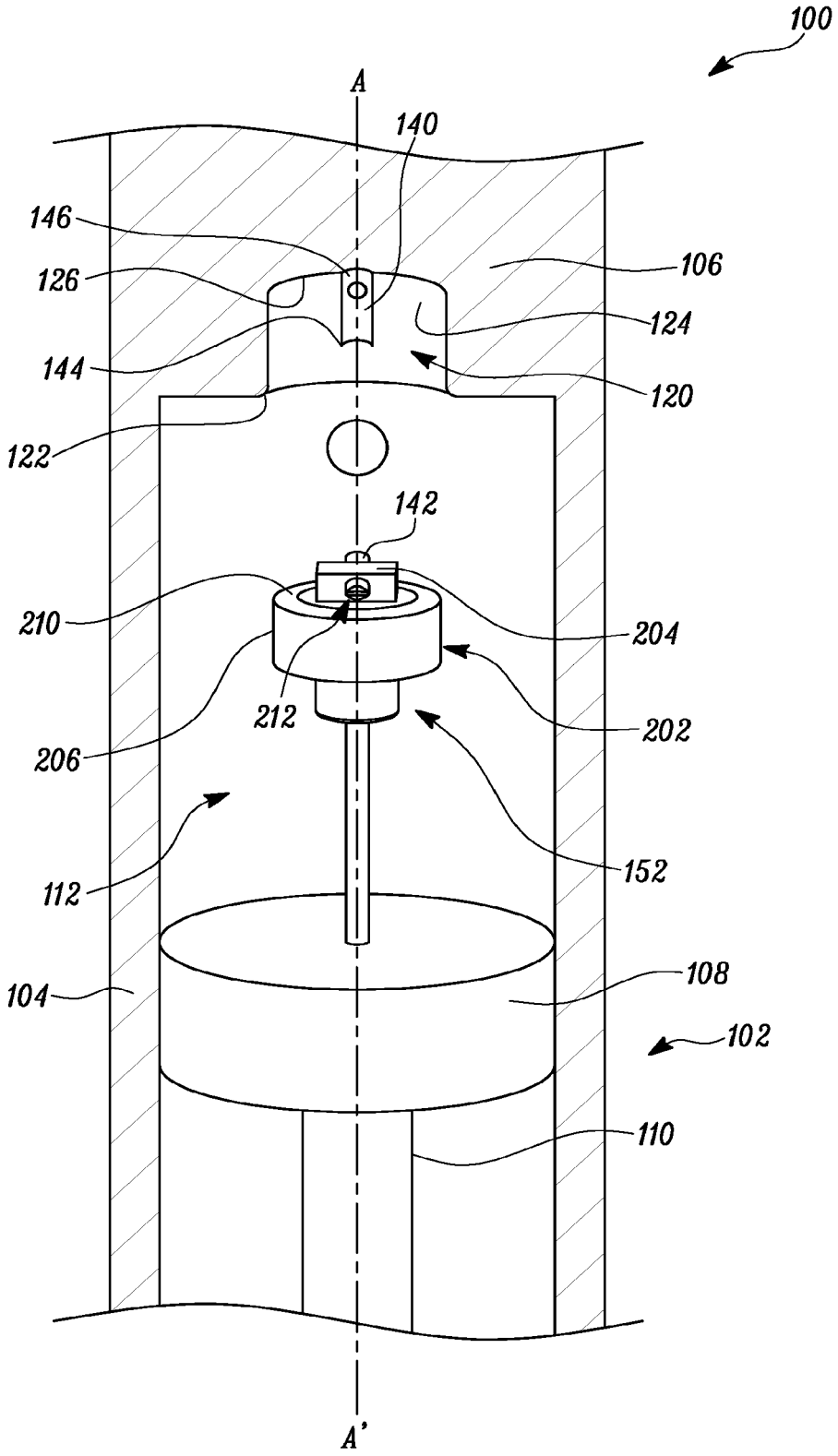
FIG. 3 is a rear sectional view of the hydraulic cylinder assembly of FIG. 1.

FIGS. 1, 2, and 3 illustrate various sectional views of a hydraulic cylinder assembly 100, according to one or more embodiments of the present disclosure.

The hydraulic cylinder assembly 100 may include a cylinder housing 102. The cylinder housing 102 may have an elongated hollow tubular configuration with a body 104 and a head cap 106. The hydraulic cylinder assembly 100 may also include a piston 108 and a rod 110 connected to the piston 108. The piston 108, with the rod 110, may slide longitudinally within the cylinder housing 102. The body 104 may define a first cavity 112 which may movably house the piston 108 and a portion of the rod 110. The cylinder housing 102 may also include an end cap 114 opposite the head cap 106.

The first cavity 112 may be defined by the body 104, between the head cap 106 and the end cap 114. The piston 108 may divide the first cavity 112 into two variable volumes on opposite sides of the piston 108. The piston 108 may change position within the first cavity 112 between a position proximate to the end cap 114 and a position proximate to the head cap 106. Change in the position of piston 108 may cause the two variable volumes to change. The two variable volumes may include a first variable volume defined between the piston 108 and the head cap 106, and a second variable volume defined between the piston 108 and the end cap 114. The end cap 114 may be provided with an opening to receive the rod 110 (also referred to as "connecting rod").

In an embodiment of the present disclosure, the cylinder housing 102 may include a set of fluid ports, such as a first fluid port 116 and a second fluid port 118 spaced apart from the first fluid port 116. The first fluid port 116 may be a through hole defined in the cylinder housing 102 that opens into the first of the two variable volumes defined within the cylinder housing 102. Likewise, the second fluid port 118 may be a through hole defined in the cylinder housing 102 that opens into the second of the two variable volumes defined within the cylinder housing 102. The first fluid port 116 and the second fluid port 118 may be adapted to be fluidly coupled to a fluid source (not illustrated) through hydraulic hoses (not illustrated), for instance. The first fluid port 116 and the second fluid port 118 may allow entry and exit of pressurized fluid to and from respective variable volumes.

A second cavity 120 may be defined within the head cap 106. The second cavity 120 (which may be referred to herein as "head space") may be positioned adjacent the first cavity 112. An interface 122, which may be chamfered, may be provided between the body 104 and the head cap 106.

In an embodiment, the second cavity 120, generally, may be a hollow portion defined within the head cap 106. More specifically, an outer surface and a top surface of the second cavity 120 may be defined by a first inner surface 124 and a top inner surface 126 of the head cap 106, while the second cavity 120 may open toward the first cavity 112. A first outer surface 128 of the head cap 106 may be provided radially outward in a first direction from the first inner surface 124 of the head cap 106. Likewise, a second outer surface 130 of the head cap 106 may be provided radially outward in a second direction from the first inner surface 124 of the head cap 106. The first direction may be opposite the second direction.

A thickness of the head cap 106 in a radial direction perpendicular to a central axis along line A-A' in FIGS. 1 and 3 may define the distance between the first inner surface 124 and the first outer surface 128. Further, a thickness of the head cap 106 in the radial direction may define the distance between the first inner surface 124 and the second outer surface 130 of the head cap 106.

The head cap 106 may include at least one access port adjacent the second cavity 120, such as a first access port 132. The first access port 132 may be a through hole that extends horizontally in the first direction to the first outer surface 128 of the head cap 106. The horizontal extension of the first access port 132 in the first direction toward the first outer surface 128 may be in the radial direction of the cylinder housing 102, perpendicular to the central axis along line A-A' in FIGS. 1 and 3. The first access port 132, therefore, may extend from the first inner surface 124 of the head cap 106 to the first outer surface 128 of the head cap 106. In alternative embodiments of the present disclosure, the first access port 132 may extend at an incline with respect to the first direction and/or the central axis along line A-A'. Discussed in more detail below, the first access port 132 may allow access to mechanically operate a retention mechanism to release and remove an in-cylinder linear position sensor 152 from the second cavity 120.

As shown in FIG. 2, the first access port 132 may be defined as a rectangular cube that extends in the first direction and has a length greater than a width, wherein the length of the rectangular cube is a dimension of the rectangular cube that extends in the first direction (i.e., radially). Alternatively, the first access port 132 may be defined as a cuboid, a cylinder, or another geometric volume. The first access port 132 may have an upward facing bottom surface 134, a downward facing top surface 136, and opposing side surfaces 138. The first access port 132 may also define an opening at the first inner surface 124 and an opening at the first outer surface 128 of the head cap 106. The opening at the first inner surface 124 and the opening at the first outer surface 128 may be spaced apart by the length of the first access port 132. In one or more embodiments, the upward facing bottom surface 134 may be substantially flat and perpendicular to the central axis along line A-A'. Alternatively, the upward facing bottom surface 134 may be substantially flat, but at an incline relative to the central axis along line A-A'. The first access port 132 may be manufactured using an Electrical Discharge Machining (EDM) manufacturing technique, for instance.

The first access port 132 may be provided with an access cover (not illustrated). The access cover may be removably connected to cover the opening of the first access port 132 at the first outer surface 128 of the head cap 106. When connected at the first outer surface 128, the access cover may preclude outside material, such as debris, from entering the first access port 132. In an example, the access cover may be a removable snap-fitting cap. In alternative examples, the access cover may be a cap connected to the head cap 106 or a grommet fitted to the first access port 132. The access cover may have provisions, such as one or more holes, to allow wires to pass from a sensor cap 204 of the in-cylinder linear position sensor 152 to outside the head cap 106.

Optionally, the head cap 106 may define at least one vertically extending groove, such as a vertically extending groove 140 (also referred to herein as "vertically extending guide groove 140"). Generally speaking, the vertically extending groove 140 may govern an orientation of the in-cylinder linear position sensor 152 for installation in the second cavity 120. As illustrated in FIG. 3, for instance, the vertically extending groove 140 may be provided at a surface of the head cap 106, in the second cavity 120. Alternatively, in one or more embodiments of the disclosed subject matter, the head cap 106 may not include any vertically extending grooves or the like. The vertically extending groove 140 may be mated with a key 142, which may be provided on a top surface 210 of sensor body 202 of the in-cylinder linear position sensor 152, to seat the in-cylinder linear position sensor 152 in a predefined alignment within the second cavity 120.

Hydraulic cylinder assemblies according to one or more embodiments of the disclosed subject matter may also include a second access port 133. Second access port 133 may be configured to provide access to a set screw or screws coupled to the in-cylinder linear position sensor 152. However, such second access port 133 and set screws may not be used in embodiments of the disclosed subject matter. As discussed herein, a retention mechanism may mechanically fix the in-cylinder linear position sensor 152 in the second cavity 120. Thus, even if second access port 133 is present, set screws may not be used to fix the in-cylinder linear position sensor 152 in the second cavity 120. Alternatively, as may be seen in FIG. 4, the hydraulic cylinder assembly 200 may not include second access port 133. Likewise, the hydraulic cylinder assembly 300 of FIG. 5 may not include second access port 133.

According to embodiments of the disclosed subject matter, hydraulic cylinder assemblies, such as hydraulic cylinder assembly 100 (FIGS. 1-3), hydraulic cylinder assembly 200 (FIG. 4), and hydraulic cylinder assembly 300 (FIG. 5), may include an in-cylinder linear position sensor 152. Generally, the in-cylinder linear position sensor 152 may measure position of the piston 108 and the rod 110 within the cylinder housing 102. The in-cylinder linear position sensor 152 may be mechanically held in the second cavity 120 of the head cap 106 by a retention mechanism discussed in more detail below.

As illustrated in FIGS. 2 and 3, in-cylinder linear position sensor 152 may include a sensor body 202 and a sensor cap 204. The sensor body 202 may have a cylindrical body with an outer surface 206. Therefore, in an end plan view, the sensor body 202 may be circular in shape. The sensor body 202 may house circuitry (not illustrated) of the in-cylinder linear position sensor 152. As illustrated in FIGS. 1-5, the sensor body 202 may be free of any set screw retention glands configured to receive one or more set screws through the optional second access port 133. In an alternative embodiment, the sensor body 202 may have one or more set screw retention glands (not illustrated) formed on the outer surface 206 of the sensor body 202, though set screws may not be used, as described above. A sensing tube 208 may extend from the sensor body 202 to the piston 108 to sense the position of the piston 108 and the rod 110 within the cylinder housing 102. The sensor cap 204 may extend from a top surface 210 (or upper surface 210) of the sensor body 202. A plurality of wires (not illustrated) may extend from the sensor cap 204, and such wires may be routed through the first access port 132 to outside the cylinder housing 102. Key 142 may extend from the top surface 210 of sensor body 202, and may be used to mate with the vertically extending groove 140 to seat the in-cylinder linear position sensor 152 in a predefined alignment within the second cavity 120.

The sensor cap 204 may have a retention mechanism configured to engage one or more surfaces of the second cavity 120, such as first access port 132 and retention interface 502, to mechanically fix the sensor cap 204 (and in-cylinder linear position sensor 152) in the second cavity 120. Generally speaking, the retention mechanism may be a "self-contained" or "self-fastening" (e.g., biased or loaded) retention mechanism in that one or more fasteners thereof, such as latches, may be biased or loaded radially outward, for instance, to return to an outermost position in the absence of a force causing the fastener to move radially inward. For example, the retention mechanism may be biased by one or more springs and optionally an internal linkage coupled to the one or more springs. Additionally or alternatively, the retention mechanism may be a settable retention mechanism in that one or more fasteners thereof, such as latches, may be set at a position between an outermost position and an innermost position. For example, one or more fasteners of the retention mechanism may be movable and set based on operation of a gear assembly, such as a rack and pinion gear assembly or a worm drive assembly.

FIGS. 1-4 illustrate a retention mechanism to mechanically fix the in-cylinder linear position sensor 152 in the second cavity 120, according to one or more embodiments of the disclosed subject matter, having a spring-loaded latch, first spring-loaded latch 212. Of course, as noted above, embodiments of the disclosed subject matter are not limited to loaded or biased latches, let alone spring-biased latches or spring-loaded latches.

Figure 4:
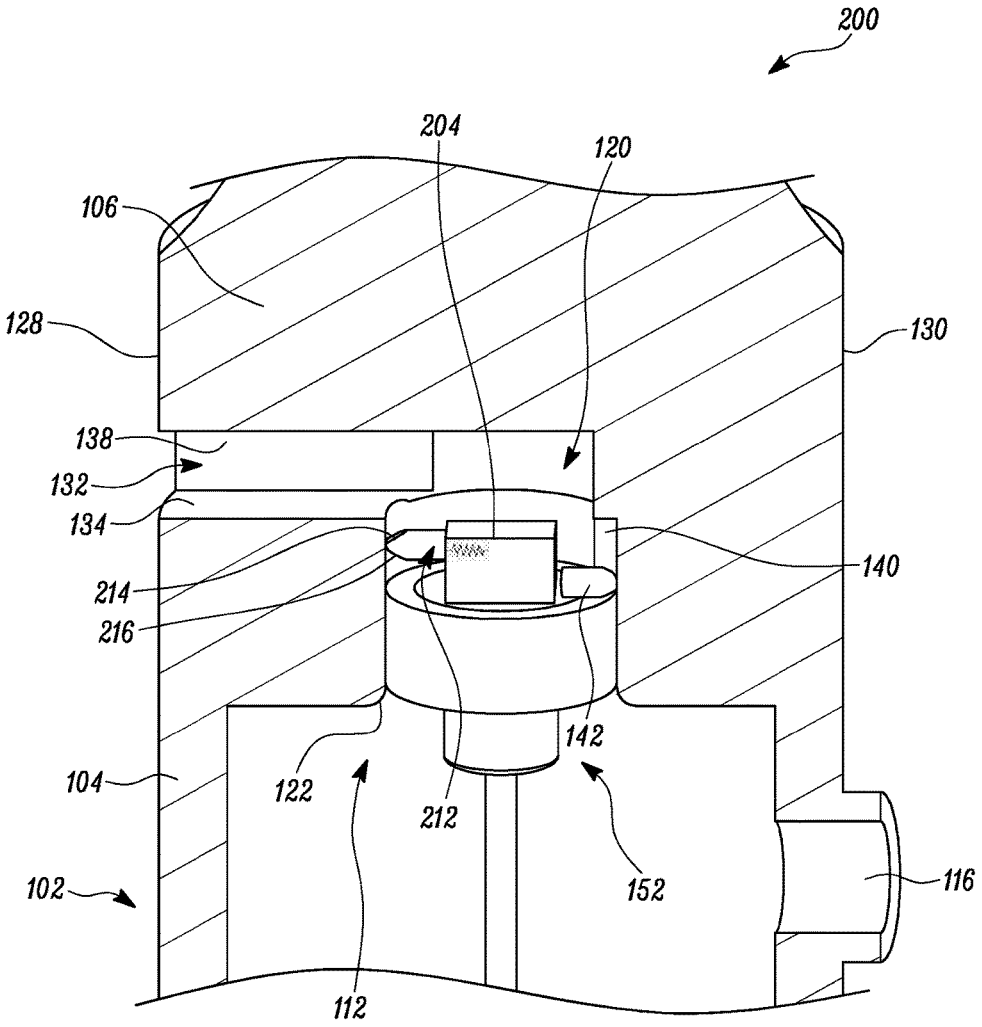
FIG. 4 is a side sectional side view of a portion of the hydraulic cylinder assembly of FIG. 1, according to one or more embodiments of the present disclosure.
Figure 5:
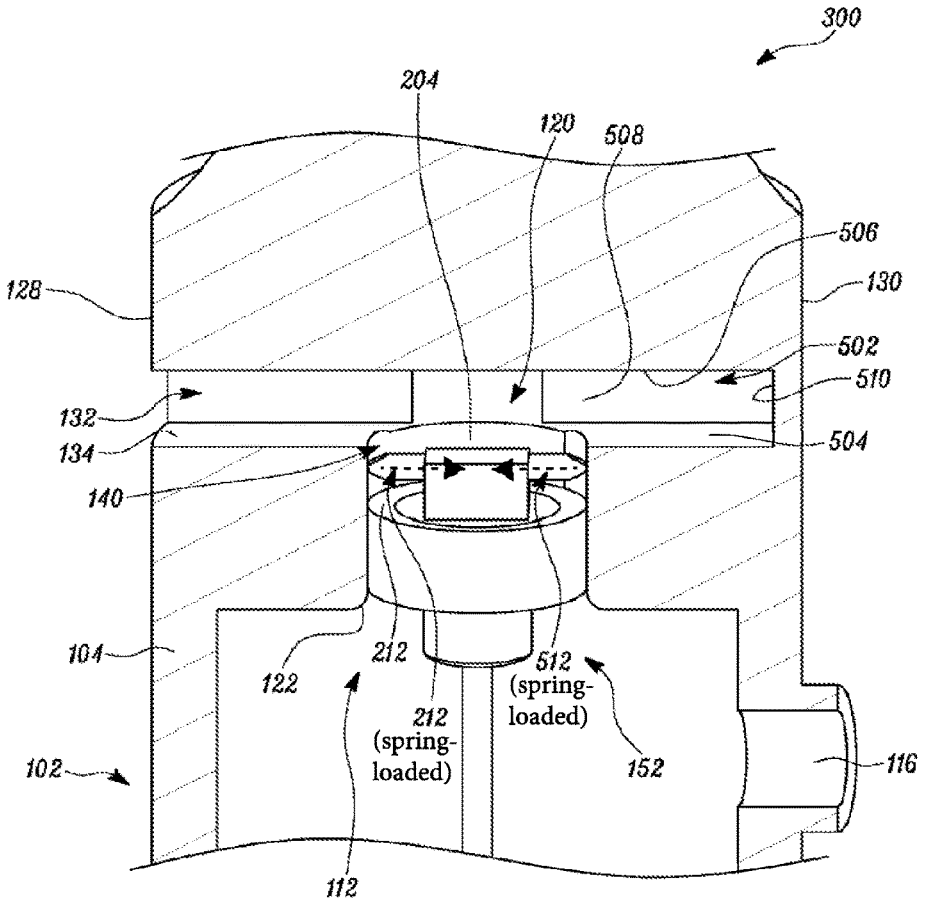
FIG. 5 is a side sectional view of a portion of a hydraulic cylinder assembly according to one or more embodiments of the present disclosure.

The first spring-loaded latch 212 may be adapted to move between an outer-most position (e.g., as shown in FIGS. 1, 2 and 3) and an inner position (e.g., as shown in FIG. 4 and FIG. 5). In the outer-most position, the spring-loaded latch 212 may be in an extended state, which may be a fully extended state. In the inner position, the spring-loaded latch 212 may be in a retracted state. In this regard, the spring-loaded latch 212 may be moved inward from the outer-most position to the retracted state, which may be a fully retracted state. Generally, the fully retracted state of the spring-loaded latch 212 may be a state in which the spring-loaded latch 212 is at its inner-most possible position relative to the central axis along line A-A', whereas the retracted state of the spring-loaded latch 212 may be a state in which the spring-loaded latch 212 is between the fully extended state and the fully retracted state.

In the extended state, the first spring-loaded latch 212 may extend horizontally in a first direction past outer surface 206 of sensor body 202. To reach a retracted position, the first spring-loaded latch 212 may be moved in a second direction opposite the first direction. More specifically, to reach the retracted state, the first spring-loaded latch 212 may be moved radially inward toward the central vertical axis along line A-A' of the sensor body 202 such that the spring-loaded latch 212 does not extend past the outer surface 206 of the sensor body 202. Thus, to remove or install the in-cylinder linear position sensor 152, the spring-loaded latch 212 may not need to be in the fully retracted state.

The first spring-loaded latch 212 may be adapted to engage with the first access port 132. Specifically, the first spring-loaded latch 212 may engage with the upward facing bottom surface 134 of the first access port 132. Engagement of the first spring-loaded latch 212 with the first access port 132 may mechanically couple the in-cylinder linear position sensor 152 to the head cap 106, in the second cavity 120. Such mechanical coupling of the in-cylinder linear position sensor 152 in the second cavity 120 of the head cap 106 may prevent movement of the in-cylinder linear position sensor 152 in the second cavity 120, which may mitigate the effects on sensor readings caused by movement of the in-cylinder linear position sensor 152 relative to the head cap 160. Depression in the second direction to a retracted position may cause the first spring-loaded latch 212 to disengage from the upward facing bottom surface 134 of the first access port 132.

The first spring-loaded latch 212 may include a body 218 with a free end having a chamfered upper end surface 214 and an inclined lower surface 216 below the chamfered upper end surface 214. The chamfered upper end surface 214 may enable insertion of the first spring-loaded latch 212 into the second cavity 120. The inclined lower surface 216 may facilitate extension of the first spring-loaded latch 212 into the first access port 132. Further, the inclined lower surface 216 may facilitate fixed engagement of the first spring-loaded latch 212 with the first access port 132 in that the mechanical force between the inclined lower surface 216 and the upward facing bottom surface 134 may increase as the inclined lower surface 216 continues to extend radially outward in the first access port 132.

Referring now to FIG. 5, the head cap 106 of a hydraulic cylinder assembly 300 may include a retention interface 502 adjacent the second cavity 120. The retention interface 502 may extend horizontally in the second direction, but may or may not reach the second outer surface 130 of the head cap 106. Thus, in one or more embodiments, the retention interface 502 may be a blind hole that does not extend through the head cap 106.

The horizontal extension of the retention interface 502 in the second direction toward the second outer surface 130 may be in the radial direction of the cylinder housing 102. The direction of extension of the first access port 132, i.e., the first direction, may be opposite the direction of extension of the retention interface 502, i.e., the second direction. In alternative embodiments of the present disclosure, the direction of extension of the first access port 132, i.e., the first direction may be at any angle with respect to the direction of extension of the retention interface 502, i.e., the second direction.

The retention interface 502 may be defined as a geometric volume, such as a cuboid, a rectangular cube having a length greater than a width extending in the second direction, or other geometric volume. Such geometric volume may be defined by an upward facing bottom surface 504, a downward facing top surface 506, and opposing side surfaces 508. Optionally, the geometric volume of the retention interface 502 may be defined by an end wall 510. In an embodiment, the retention interface 502 may be identical in shape to the first access port 132.

As illustrated in FIG. 5, the sensor cap 204 may have a retention mechanism with a first latch 212 and a second latch 512, each of which may be biased or settable as discussed above, and adapted to move between an outer-most position and an inner-most position. Though not intended to limit embodiments of the disclosed subject matter to biased latches, let alone spring-biased latches, first latch 212 and second latch 512 may hereinafter be referred to as first spring-loaded latch 212 and second spring-loaded latch 512, respectively. In the outer-most position, the second spring-loaded latch 512 may be in a fully extended state, while in the inner-most position the second spring-loaded latch 512 may be in a fully retracted state.

In an extended state, the second spring-loaded latch 512 may extend horizontally in the second direction, and in a retracted position the second spring-loaded latch 512 may be retracted in the first direction. In an extended state, the second spring-loaded latch 512 may extend past the outer surface 206 of the sensor body 202. To reach a retracted state, the second spring-loaded latch 512 may move radially inward toward the central vertical axis A-A' of the sensor body 202 such that the second spring-loaded latch 512 does not extend past the outer surface 206 of the sensor body 202.

Thus, to remove or install the in-cylinder linear position sensor 152, the spring-loaded latch 512 may not need to be in the fully retracted state.

In various embodiments of the present disclosure, the sensor cap 204 may also house one or more resilient members (not shown) such as coiled springs, in connection with the first spring-loaded latch 212 and/or the second spring-loaded latch 512, to bias the first spring-loaded latch 212 and/or the second spring-loaded latch 512. Therefore, radial inward movement of the first spring-loaded latch 212 may cause radially inward movement of the second spring-loaded latch 512. Also, movement radially outward of the first spring-loaded latch 212 may allow radial outward movement of the second spring-loaded latch 512. Optionally, the first spring-loaded latch 212 and the second spring-loaded latch 512 may actuate simultaneously with each other in the radially inward direction and/or the radially outward direction.

Similar to above, the first spring-loaded latch 212 may be adapted to engage with the first access port 132. Specifically, the first spring-loaded latch 212 may engage with the upward facing bottom surface 134 of the first access port 132. Likewise, the second spring-loaded latch 512, which may have a body portion the same as or similar to the body portion 218 of the first spring-loaded latch 212, may be adapted to engage with the retention interface 502. More specifically, the second spring-loaded latch 512 may be adapted to engage with the upward facing bottom surface 504 of the retention interface. Further, depressing the first spring-loaded latch 212 radially inward may cause the second spring-loaded latch 512 to move radially inward to disengage from the retention interface 502.

As noted above, the sensor cap 204 of the in-cylinder linear position sensor 152 may enable the in-cylinder linear position sensor 152 to be mechanically held in the second cavity 120 of the head cap 106. To hold the in-cylinder linear position sensor 152 in the second cavity 120, the in-cylinder linear position sensor 152 may be received in the first cavity 112 and aligned with the chamfered interface 122. The chamfered upper end surface 214 of at least the first spring-loaded latch 212 may be pressed against the chamfered interface 122 and depressed so as to move radially inward. In the embodiment of FIG. 5, the second spring-loaded latch 512 may additionally be pressed against the chamfered interface 122 so as to move radially inward. Alternatively, in a case where the latches 212 are settable and not necessarily biased or loaded, the latch 212 and/or the latch 512 may be in a retracted state such that neither latch extends to reach the first inner surface 124.

The first spring-loaded latch 212 (and the in-cylinder linear position sensor 152) may be pushed further into the second cavity 120 until the first spring-loaded latch 212 reaches the first access port 132. When the first spring-loaded latch 212 reaches the first access port 132, the first spring-loaded latch 212 may extend into the first access port 132 to engage the upward facing bottom surface 134 of the first access port 132. In one or more embodiments that do not include a retention interface 502, a top surface of the sensor cap 204 may abut an edge formed in the head cap 106, such as illustrated in FIG. 1 and FIG. 2. In an embodiment with a retention interface 502, such as illustrated in FIG. 5, when the second spring-loaded latch 512 reaches the retention interface 502, the second spring-loaded latch 512 may extend so as to engage the upward facing bottom surface of the retention interface 502. Thus, the first spring-loaded latch 212 and the second spring-loaded latch 512 may both mechanically fix the in-cylinder linear position sensor 152 in the second cavity 120.

The in-cylinder linear position sensor 152 may be withdrawn from the second cavity 120 of the head cap 106 by movement of the first spring-biased latch 212 radially inward by an amount to disengage the first spring-biased latch 212 from the first access port 132 and such the first spring-biased latch 212 does not extend past an inner diameter defined by the first inner surface 124 of the second cavity 120. For example, to disengage the in-cylinder linear position sensor 152, a pushing force may be applied to a free end of the first spring-loaded latch 212 so as to move the first spring-loaded latch 212 radially inward by at least a predetermined amount such that the first spring-loaded latch 212 disengages from the upward facing bottom surface 134 of the first access port 132. Any elongated rigid member (not illustrated), such as a rod, a screwdriver, any other appropriate probe, etc., may be used to push the first spring-loaded latch 212.

Subsequently, the sensor body 202 and the sensor cap 204 may be withdrawn from the second cavity 120 of the head cap 106. In the case of an embodiment having a second spring-biased latch 512, the sensor cap 204 may be configured such that movement radially inward of the first spring-loaded latch 212 causes radial movement inward of the second spring-biased latch 512. Thus, to remove the in-cylinder linear position sensor 152 from the second cavity 120, the second spring-biased latch 512 may also be caused to move radially inward by an amount to disengage the second spring-biased latch 512 from the retention interface 502, and such the second spring-biased latch 512 does not extend past an inner diameter defined by the first inner surface 124 of the second cavity 120.

INDUSTRIAL APPLICABILITY

The present disclosure relates to hydraulic cylinder assemblies, such as the hydraulic cylinder assembly 100, the hydraulic cylinder assembly 200, and the hydraulic cylinder assembly 300, and to in-cylinder linear position sensors, such as the in-cylinder linear position sensor 152. The present disclosure also relates to a method 600 of selectively retaining and releasing an in-cylinder linear position sensor in a hydraulic cylinder housing, and a method 700 of providing a hydraulic cylinder assembly or components thereof.

Figure 6:
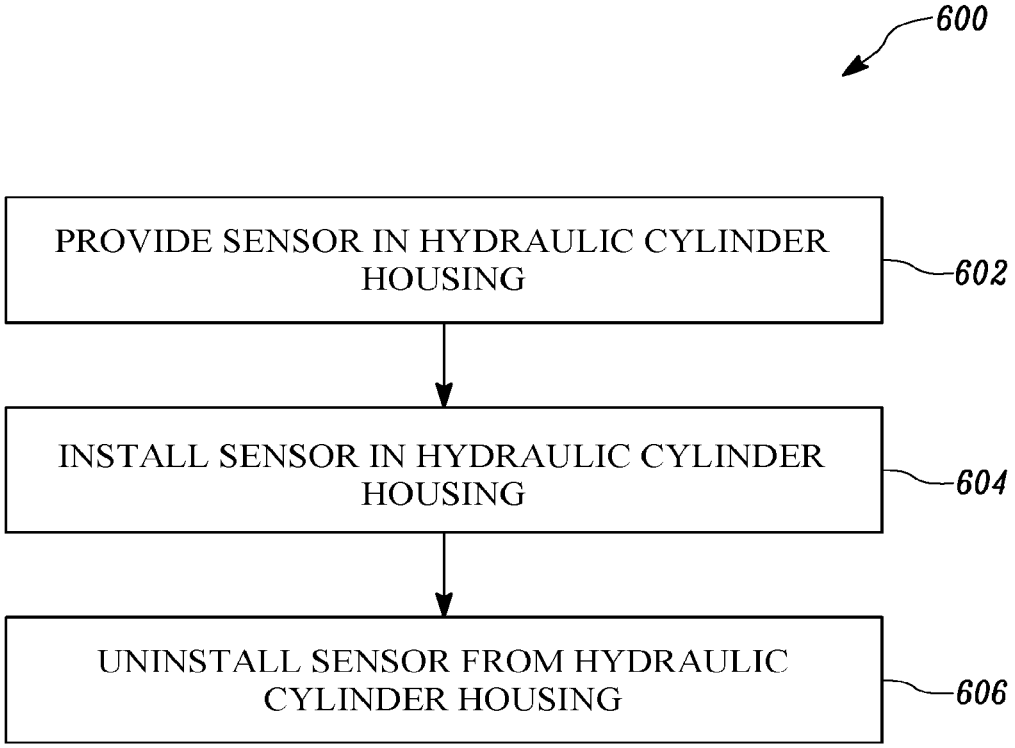
FIG. 6 is a flowchart of a method of providing an in-cylinder linear position sensor relative to a hydraulic cylinder housing according to one or more embodiments of the present disclosure.

FIG. 6 illustrates the flow chart of the method 600 for selectively retaining and releasing an in-cylinder linear position sensor in a hydraulic cylinder housing, such as cylinder housing 102.

The method 600, at operation 602, may include providing a sensor, such as the in-cylinder linear position sensor 152, in a hydraulic cylinder housing, such as the hydraulic cylinder housing 102. For example, at operation 602, the in-cylinder linear position sensor 152 may be received in the first cavity 112 such that the chamfered interface 122 is pressed against the chamfered upper end surface 214 of the first spring-loaded latch 212 (and the second spring-loaded latch 512 if present).

The method 600, at operation 604, may include installing the in-cylinder linear position sensor 152 in the hydraulic cylinder housing 102. To install the in-cylinder linear position sensor 152 in the hydraulic cylinder housing 102, the in-cylinder linear position sensor 152 may be pushed to move along the axis A-A', as the first spring-loaded latch 212 and the second spring-loaded latch 512 (if present) slide along either the first inner surface 124 of the second cavity 120, or the first vertically extending groove 140 and the second vertically extending groove 142, respectively, if present. As the first spring-loaded latch 212 and the second spring-loaded latch 512 reach the first access port 132 and the retention interface 502, respectively, the first spring-loaded latch 212 may engage the first access port 132, and the second spring-loaded latch 512, if present, may engage the retention interface 502. Optionally, for installation, key 142 may be provided to mate with vertically extending groove 140 to seat the in-cylinder linear position sensor 152 in a predefined alignment within the second cavity 120.

The method 600, at operation 606, may include uninstalling the in-cylinder linear position sensor 152 from the second cavity 120 of the hydraulic cylinder housing 102. At operation 606, the first spring-loaded latch 212 may be caused to move radially inward, for example, in response to a pushing force on a free end thereof, such that the first spring-loaded latch 212 disengages from the upward facing bottom surface 134 of the first access port 132. If present, the second spring-loaded latch 512 may be caused to disengage from the upward facing bottom surface 504 of the second access port 502 responsive to the radial movement inward of the first spring-loaded latch 212.

Figure 7:
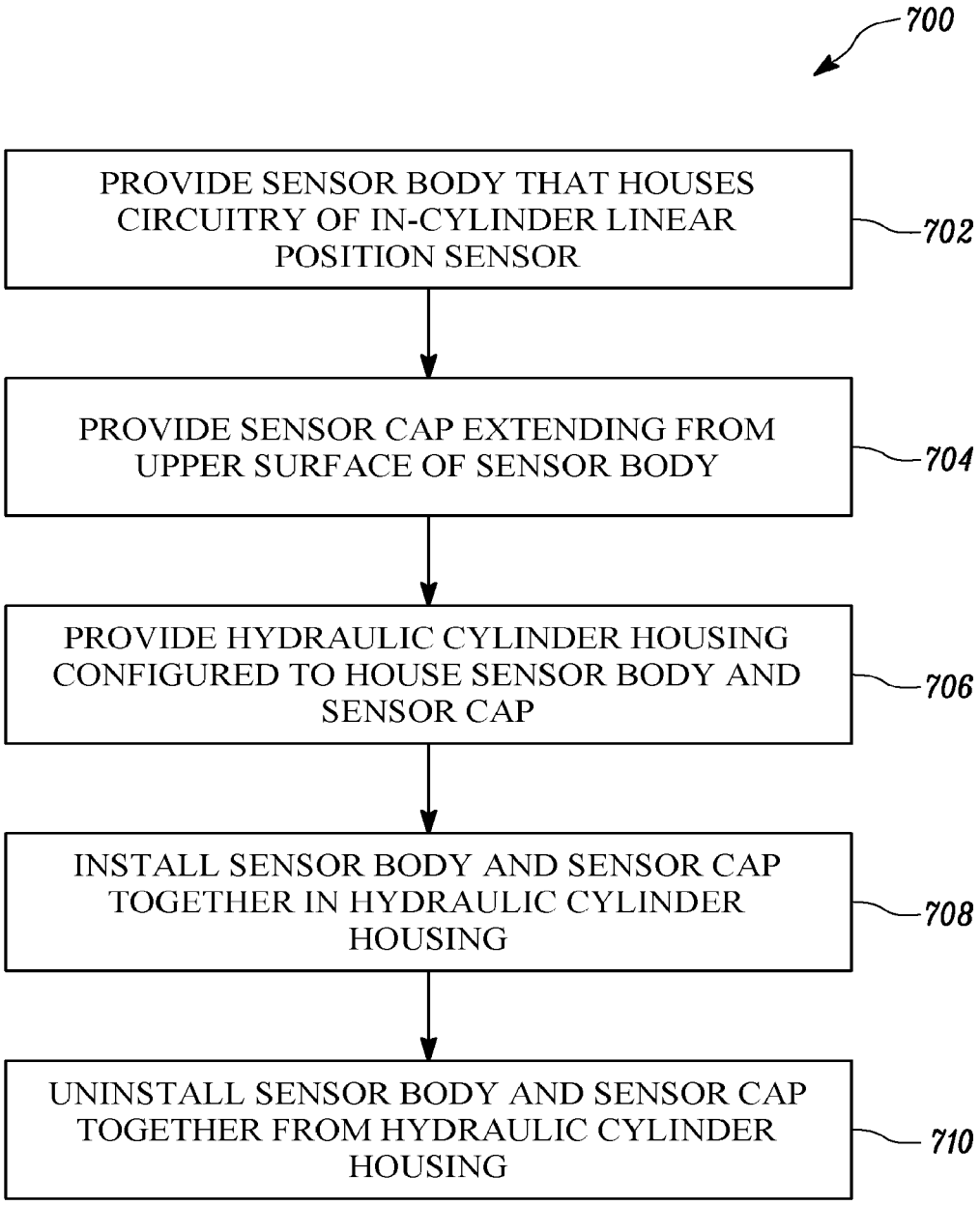
FIG. 7 is a flowchart of a method of providing a hydraulic cylinder assembly, including components thereof, according to one or more embodiments of the present disclosure.

FIG. 7 illustrates a flow chart of the method 700 of providing a hydraulic cylinder assembly or components thereof.

At operation 702, the method 700 may include providing a sensor body, such as the sensor body 202 that houses circuitry of the in-cylinder linear position sensor 152.

At operation 704, the method 700 may include providing a sensor cap, such as the sensor cap 204, extending from an upper surface of the sensor body 202. The sensor cap 204 may have a retention mechanism, such as a biased retention mechanism that includes, for example, the first spring-loaded latch 212 extending radially outward relative to a central vertical axis of the sensor body 202, or that includes the first spring-loaded latch 212 and the second spring-loaded latch 512. The retention mechanism may be configured to have a portion or portions (e.g., spring-loaded latches) that retract for insertion and removal in a cavity, such as first cavity 120. For example, the first spring-loaded latch 212 may move inward from an outer-most position toward the central vertical axis of the sensor body 202.

At operation 706, the method 700 may include providing a hydraulic cylinder housing, such as cylinder housing 102, configured to house an in-cylinder linear position sensor that includes the sensor body and the sensor cap extending from the sensor body.

At operation 708, the method 700 may include installing an in-cylinder linear position sensor, such as in-cylinder linear position sensor 152, in the second cavity 120 of the cylinder housing 102. Installation may include moving the in-cylinder linear position sensor 152 into and through the first cavity 112 to reach the second cavity 120. In one or more embodiments of the disclosed subject matter, for installation, key 142 may be provided to mate with vertically extending groove 140 to seat the in-cylinder linear position sensor 152 in a predefined alignment within the second cavity 120. When the retention mechanism reaches a predetermined access port, such as first access port 132 and optionally a retention interface, such as retention interface 502, the retention mechanism may engage the access port and optional retention interface to mechanically couple the in-cylinder linear position sensor 152 in the second cavity 120. Optionally, a top surface top surface 210 of the sensor body 202 or sensor cap 204 may abut an edge of the head cap 106 to assist with the mechanical coupling of the in-cylinder linear position sensor 152 in the second cavity 120.

Operation 710, which in one or more embodiments of the disclosed subject matter may begin a separate method, may include uninstalling the in-cylinder linear position sensor, such as in-cylinder linear position sensor 152, from the cylinder housing 102. To uninstall the in-cylinder linear position sensor 152, the retention mechanism may disengage from the access port and optional retention interface. For example, a pushing force may be exerted on a free end of the first spring-loaded latch 212 to disengage the first access port 132 and thereby release the in-cylinder linear position sensor 152 from its fixed position in the second cavity 120. The in-cylinder linear position sensor 152 may then be pulled from the second cavity 120 into the first cavity 112 and out of the cylinder housing 102.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A hydraulic cylinder assembly comprising:

a cylinder housing including:

a body that defines a first cavity to movably house piston and a portion of a rod connected to the piston, and a head cap adjacent the body that defines a second cavity adjacent the first cavity, a first access port adjacent the second cavity that extends radially in a first direction to a first outer surface of the head cap, and a second access port that extends radially in a second direction to a second outer surface of the head cap; and an in-cylinder linear position sensor mechanically held in the second cavity, the in-cylinder linear position sensor including:

a sensor cap extending from a top surface of a sensor body of the in-cylinder linear position sensor, the sensor cap having a retention mechanism with a latch extending radially in the first direction so as to engage an upward facing bottom surface of the first access port, wherein the first access port extends in the first direction and has a length greater than a width, wherein the length of the first access port is a dimension of the first access port that extends in the first direction, and wherein the latch includes a chamfered upper end surface configured to interact with a chamfered interface between the body and the head cap of the cylinder housing to insert the in-cylinder linear position sensor into the second cavity.

2. The hydraulic cylinder assembly of claim 1, wherein the in-cylinder linear position sensor is free of any set screw retention glands.

3. The hydraulic cylinder assembly of claim 1, wherein the first direction is opposite the second direction.

4. The hydraulic cylinder assembly of claim 3, wherein the latch is a spring-loaded latch, wherein the sensor cap has another spring-loaded latch that extends in the second direction so as to engage a portion of an upward facing surface of the head cap opposite the first access port, and wherein the spring-loaded latch is configured to be depressed in the second direction to disengage the upward facing bottom surface of the first access port to remove the in-cylinder linear position sensor from the second cavity and to disengage the another spring-loaded latch from the portion of the upward facing surface of the head cap opposite the first access port.

5. The hydraulic cylinder assembly of claim 1, wherein the latch is a spring-loaded latch, wherein the spring-loaded latch further includes an inclined lower surface to increasingly engage the upward facing bottom surface of the first access port, and wherein the spring-loaded latch is configured to be depressed in the second direction to disengage from the upward facing bottom surface of the first access port to remove the in-cylinder linear position sensor from the second cavity.

6. The hydraulic cylinder assembly of claim 1, wherein the second access port includes a cylindrical portion sized to receive a set screw.

7. The hydraulic cylinder assembly of claim 1, wherein the head cap defines a vertically extending groove configured to govern an orientation of the in-cylinder linear position sensor for installation in the second cavity.

8. An in-cylinder linear position sensor configured to be mechanically held in a cavity of a housing of a hydraulic cylinder assembly, the in-cylinder linear position sensor comprising:

a sensor body configured to house circuitry of the in-cylinder linear position sensor; and a sensor cap extending from an upper surface of the sensor body, the sensor cap having a spring-loaded latch biased by a coiled spring that extends directly radially past an outer surface of the sensor body in a fully extended state of the latch, wherein the spring-loaded latch has a chamfered upper surface portion and an inclined lower surface portion, and wherein the spring-loaded latch is configured to move radially inward from an outer-most position of the fully extended state toward a central vertical axis of the sensor body.

9. The in-cylinder linear position sensor of claim 8, wherein the sensor body is free of any set screw retention glands.

10. The in-cylinder linear position sensor of claim 8, wherein the sensor cap has another latch that extends radially past the outer surface of the sensor body in a fully extended state of the another latch, and wherein the spring-loaded latch extends in a first direction and the another latch extends in a second direction opposite the first direction.

11. The in-cylinder linear position sensor of claim 10, wherein the radially inward movement of the spring-loaded latch causes radially inward movement of the another latch from an outer-most position of the another latch in the fully extended state of the another latch.

12. The in-cylinder linear position sensor of claim 8, wherein the sensor body is circular in an end plan view of the in-cylinder linear position sensor.

13. A method comprising:

providing a sensor body that houses circuitry of an in-cylinder linear position sensor; and providing a sensor cap extending from an upper surface of the sensor body, the sensor cap having a spring-loaded latch biased by a coiled spring that extends directly radially outward relative to a central vertical axis of the sensor body, wherein the spring-loaded latch is configured to move inward from an outer-most position toward the central vertical axis of the sensor body.

14. The method of claim 13, further comprising providing a hydraulic cylinder assembly housing configured to house the sensor body and the sensor cap, wherein the hydraulic cylinder assembly housing includes:

a body that defines a first cavity to movably house a piston and a portion of a rod connected to the piston, and a head cap adjacent the body that defines a second cavity adjacent the first cavity and a first access port adjacent the second cavity that extends in a first direction to a first outer surface of the head cap.

15. The method of claim 14, wherein the head cap of the hydraulic cylinder assembly housing is free of any set screw access ports.

16. The method of claim 14, further comprising inserting the sensor cap and the sensor body into the second cavity by way of the first cavity such that the spring-loaded latch engages an upward facing bottom surface of the first access port.

17. The method of claim 16, further comprising:

pushing radially inward the spring-loaded latch by at least a predetermined amount such that the spring-loaded latch disengages the upward facing bottom surface of the first access port; and withdrawing the sensor body and the sensor cap from the second cavity after the pushing the spring-loaded latch radially inward by at least the predetermined amount.

18. The method of claim 13, wherein the sensor cap has a second latch that extends radially outward relative to the central vertical axis of the sensor body, and wherein the second latch is configured to move inward toward the central vertical axis of the sensor body in correspondence with inward movement of the spring loaded latch toward the central vertical axis of the sensor body, and is configured to move outward, away from the central vertical axis of the sensor body in correspondence with outward movement of the spring-loaded latch, away from the central vertical axis of the sensor body.

19. The method of claim 18, wherein the spring-loaded latch includes one or more of a chamfered upper surface portion or an inclined lower surface portion.

* * * * *